US011721943B1

(12) United States Patent
Lin et al.

(10) Patent No.: US 11,721,943 B1
(45) Date of Patent: Aug. 8, 2023

(54) LIGHT BULB HOLDER STRUCTURE AND LIGHT

(71) Applicant: ZHANGZHOU GO WIN LIGHTING CO., LTD, Zhangzhou (CN)

(72) Inventors: Xiongzhong Lin, Zhangzhou (CN); Qingan Wu, Zhangzhou (CN); Zhongyi Lin, Zhangzhou (CN)

(73) Assignee: ZHANGZHOU GO WIN LIGHTING CO., LTD, Zhangzhou (CN)

( * ) Notice: Subject to any disclaimer, the term of this patent is extended or adjusted under 35 U.S.C. 154(b) by 0 days.

(21) Appl. No.: 18/054,155

(22) Filed: Nov. 10, 2022

(30) Foreign Application Priority Data

Oct. 18, 2022 (CN) ..... 202211276416.7

(51) Int. Cl.
*H01R 33/22* (2006.01)
*F21V 15/00* (2015.01)
*F21V 17/12* (2006.01)

(52) U.S. Cl.
CPC ..... *H01R 33/22* (2013.01); *F21V 15/00* (2013.01); *F21V 17/12* (2013.01)

(58) Field of Classification Search
CPC ..... H01R 33/22; F21V 17/12
See application file for complete search history.

(56) References Cited

U.S. PATENT DOCUMENTS

2018/0145470 A1* 5/2018 Huang ..... H01R 31/06

* cited by examiner

*Primary Examiner* — Andrew J Coughlin
*Assistant Examiner* — Jessica M Apenteng

(57) ABSTRACT

A light bulb holder structure includes a bulb cap and a connector. By integral molding, the connector made of insulating material is molded with one end of the bulb cap to form an integration. The protrusion on the connector can increase the creepage distance of the light bulb, so as to improve waterproof performance of the light bulb and suppress erosion caused by ingress of water. In addition, the bulb cap may further be provided with connection parts to secure the combination of the connector and the bulb cap. Further, the end portion of the connector close to bulb cap may be provided with a threaded segment, and the threaded segment is an optional structure which can not only greatly improve the creepage distance, but also fix the relative position of the connector and the bulb cap when the light bulb is screwed into the socket.

9 Claims, 6 Drawing Sheets

LIGHT BULB HOLDER STRUCTURE AND LIGHT

CROSS-REFERENCE TO RELATED APPLICATIONS

This application is based upon and claims priority to Chinese Patent Application No. 202211276416.7, filed on Oct. 18, 2022, the entire contents of which are incorporated herein by reference.

TECHNICAL FIELD

The present disclosure relates to the technical field of lamp structures, in particular to a light bulb holder structure and a light.

BACKGROUND

Light bulb holder is a key part which connects the light bulb and socket. The light bulb holder can directly affect the service life and stability of the light bulb or lamp. Usually, most light bulb holders are not waterproof or only have limited waterproof ability, especially when the bulb is mounted transversely outdoors or in an environment lacking waterproof measures or means for avoiding water, water is likely to be accumulated with a certain thickness between the socket and bulb when the light gets wet by water. Since rain water or domestic water is conductive, the water accumulated between the socket and the bulb may cause electrodischarge and ignition between the two electrodes of the light bulb holder, and eventually lead to erosion and failure of the electrodes of the light bulb.

Creepage distance, as an important indicator of light bulbs, refers to the shortest path between two conductive parts or between a conductive part and a protective interface of equipment measured along the surface of insulation. Concerning the electrode erosion caused because water gets into the socket, some of the commercially available light bulbs are designed by modifying the structure of the light bulb holder to increase the creepage distance, thereby reducing the probability of spark generation when water gets into the socket. However, upon most occasions, the bulb holder is modified by adding a separately installed insulator at the tip end of the bulb holder to increase the spacing between the conductive parts, and thereby increasing the creepage distance. Such modified structure may often worsen the waterproof performance of the bulb holder due to unsatisfactory assembling quality of the insulator. Additionally, in the process of use, the insulator will suffer repeated thermal expansion and contraction, once the insulator falls off from the bulb holder, the waterproof performance of the bulb will become even worse. Therefore, how to effectively reconstruct the bulb holder to improve the creepage distance while ensuring waterproof ability and use stability of the bulb holder structure is a very practical issue in the art.

SUMMARY OF THE DISCLOSURE

In view of the above problem, one object of the present disclosure is to provide a light bulb structure and a light which are reliable in implementation, have good waterproof performance, good sealing performance, and is convenient for manufacture.

In order to realize the above-mentioned technical purpose, the technical solution adopted in the present disclosure is describe below.

A light bulb holder structure, includes:

a bulb cap, wherein the bulb cap has a cylindrical structure and is formed of a conductive material, and an end of the bulb cap is connectable with a light socket;

a connector, wherein the connector is made of insulating material and is molded at the end of the bulb cap to form an integration, a center of the connector is provided with a protrusion extending outward from the connector in a direction away from the bulb cap, a center of the protrusion is provided with a through hole, the through hole is used for inserting a conductive element, the end of the bulb cap is provided with a connection part fitted and connected with the connector, and the connection part is a through hole or a blind hole.

As a possible implementation, further, an outer circumferential side of the bulb cap is provided with connection threads matched with the light socket, and the protrusion has a shape of circular truncated cone.

As a possible implementation, further, a end portion of the protrusion away from the bulb cap is further provided with a sunken portion matched with a structure of the conductive element.

As one implementation structure of the connector, further, an end portion of the connector close to the bulb cap is provided with a threaded segment matched with a structure of the end of the bulb cap, and threads on the threaded segment suit the connection threads.

As a preferable implementation, the threaded segment of the connector is 0.1-0.3 times the length of the bulb cap in axial direction of the bulb cap.

As a preferable implementation, the connector is a hollow shell structure, an inner diameter of an end portion of the threaded segment close to the bulb cap is smaller than that of the bulb cap, and the end portion of the threaded segment close to the bulb cap is fitted with an inner peripheral side of the end of the bulb cap.

As a preferable implementation, more than one connection part is provided and the connection parts are spaced with intervals on a circumferential sidewall of the bulb cap at the end close to the threaded segment, and the end portion of the threaded segment close to the bulb cap is provided with convex parts extending outward, and the convex parts are arranged in one-to-one correspondence with the connection parts and are filled in the connection parts; when the connection parts are blind holes, the connection parts are arranged on an inner circumferential side of the bulb cap; when the connection parts are through holes, an outer contour of the convex parts suits with an outer circumferential side of the bulb cap.

As another implementation structure of the connector, further, the end of the bulb cap close to the connector is provided with a contracted part, more than one connection part is provided, and the connection parts are arranged on the contracted part at intervals.

As a preferable implementation, the connection parts are through holes, and the end portion of the connector close to the bulb cap penetrates into the contracted part to partially encapsulate the contracted part and completely encapsulate the connection parts.

According to another aspect, the present disclosure also provides a light, the light includes the above-mentioned light bulb holder, and the light may be one of the light bulbs that constitute a light string or an individual light bulb for illumination.

Compared with the prior art, the present disclosure has the following advantages. According to the present disclosure, the connector made of insulating material is molded with one end of the bulb cap to form an integration (injection molding integration). The protrusion on the connector extending away from the bulb cap can increase the creepage distance after the bulb holder structure is assembled into a complete light bulb, so as to improve waterproof performance of the light bulb and suppress erosion caused by ingress of water. In addition, the bulb cap may further be provided with connection parts to secure the combination of the connector and the bulb cap. Further, the end portion of the connector close to bulb cap may be provided with a threaded segment, and the threaded segment is an optional structure which can not only greatly improve the creepage distance, but also fix the relative position of the connector and the bulb cap when the light bulb is screwed into the socket. Under such configuration, the solutions of the present disclosure generally have the following advantages: the structure is reliable in implementation, has good waterproof performance, good sealing performance, and good market prospect.

BRIEF DESCRIPTION OF THE DRAWINGS

In order to make the description of the embodiments of the present disclosure or the technical solutions in the prior art clearer, drawings that are used for illustrating the embodiments or prior art are briefly introduced below. Obviously, the drawings described below merely contain some embodiments of the present disclosure. For those of ordinary skill in the art, other drawings may also be derived according to these drawings without creative efforts.

DETAILED DESCRIPTION OF THE EMBODIMENTS

The present disclosure will be further described in detail below with reference to the accompanying drawings and embodiments. It is particularly pointed out that the following embodiments are only used to illustrate the present disclosure rather than limit the scope of the present disclosure. Likewise, the following embodiments constitute part of rather than all embodiments of the present disclosure, and all other embodiments derived by those of ordinary skill in the art without creative effort fall within the scope of protection of the present disclosure.

Embodiment 1

Figure 1:
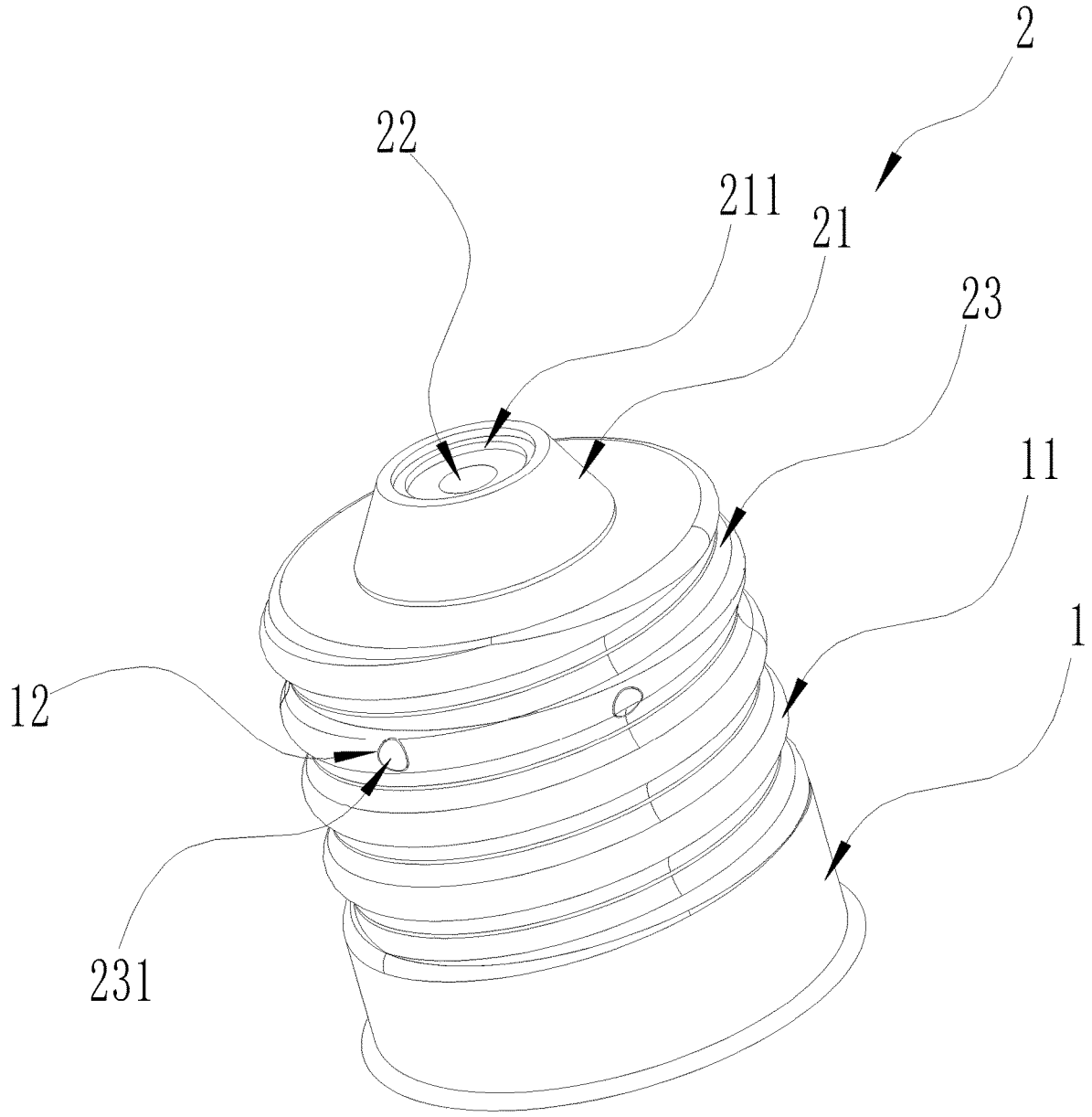
FIG. 1 is a schematic diagram showing one implementation structure of a bulb cap according to embodiment 1 of the present disclosure.
Figure 2:
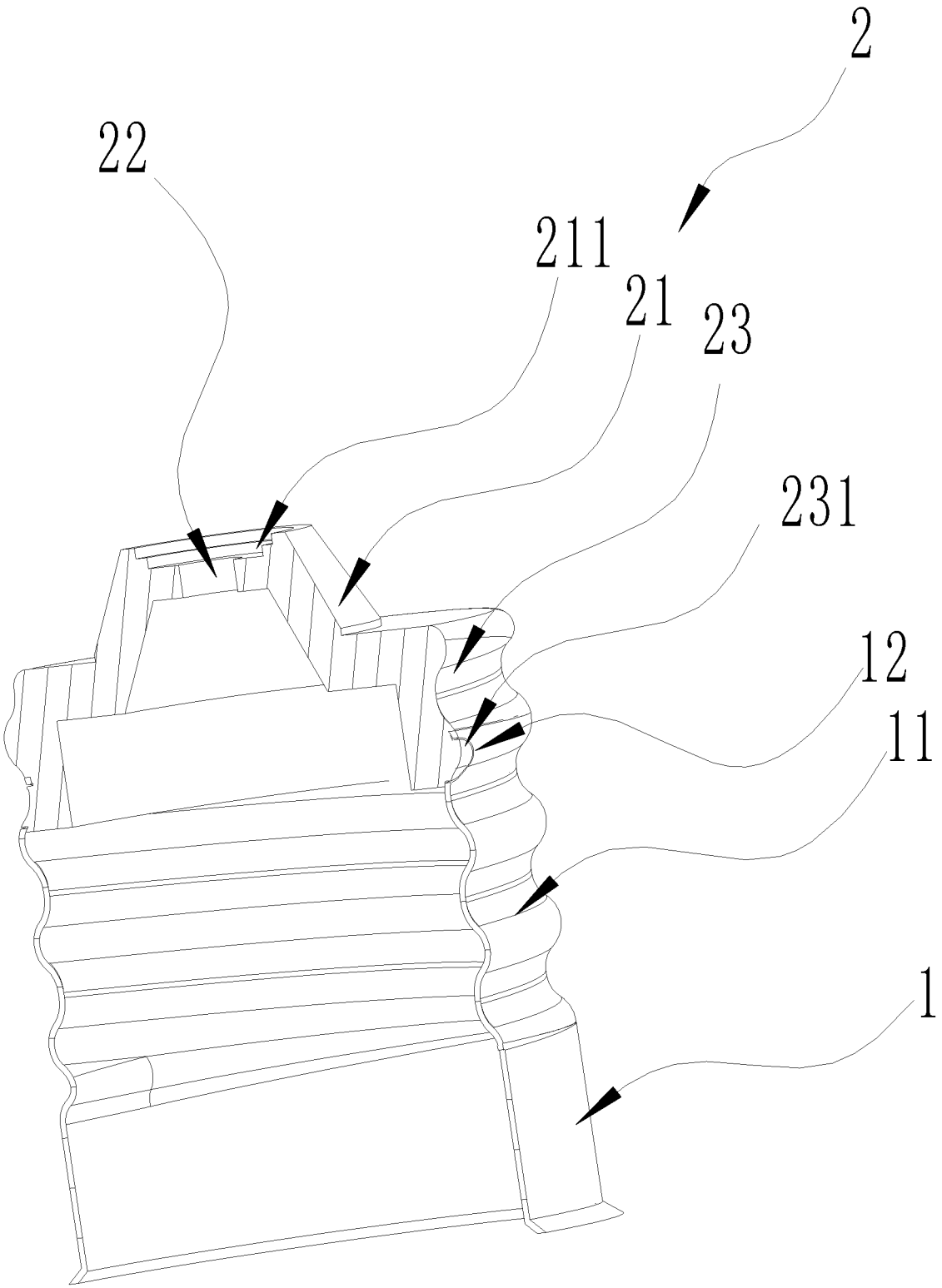
FIG. 2 is a cross-sectional diagram showing one implementation structure of a bulb cap according to embodiment 1 of the present disclosure.
Figure 3:
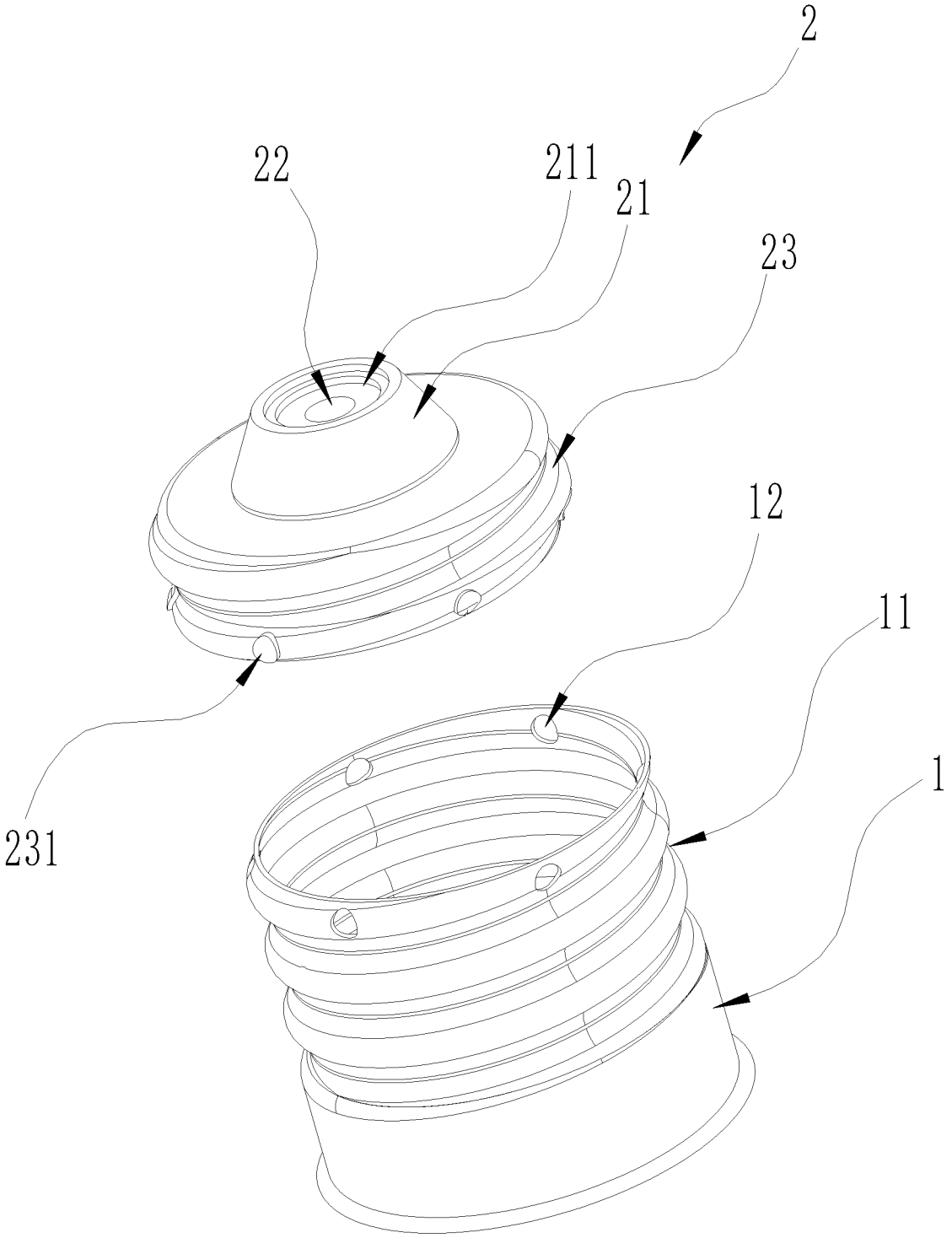
FIG. 3 is an exploded view showing one implementation structure of a bulb cap according to embodiment 1 of the present disclosure.

As shown in FIGS. 1-3, the present embodiment provides a light bulb holder structure, which includes a bulb cap 1 and a connector 2. The bulb cap 1 has a cylindrical structure and is formed of a conductive material (for example, copper), and an end of the bulb cap 1 is connectable with a light socket. The connector 2 is made of insulating material (for example, plastics or silicone) and is integrally formed at the end of the bulb cap 1, a center of the connector 2 is provided with a protrusion 21 extending outward from the connector 2 in a direction away from the bulb cap 1, a center of the protrusion 21 is provided with a through hole 22, the through hole 22 is used for inserting a conductive element (in practice, conductive element may be conductive rivet).

In addition, when the connector 2 is integrally formed at the end of the bulb cap 1 by injection molding, if the joint between the connector 2 and the bulb cap 1 is insufficient, there may still be the chance that the connector 2 becomes detached with the bulb cap 1. Especially after long-term use of the bulb, repeated thermal expansion and contraction of the connector 2 may affect the strength of the joint with the bulb cap 1. Therefore, in this embodiment, the end of the bulb cap 1 is provided with connection part 12 that is fitted and connected with the connector 2. The connection part 12 may be a through hole, but it is not limited to the form of through hole, it may also be a blind hole. The shape of the connection part 12 may be circular, triangular, quadrilateral or other polygonal structures and so on.

In order to facilitate the installation of the light bulb, in this embodiment, an outer circumferential side of the bulb cap 1 is provided with connection threads 11 matched with the light socket. In this embodiment, the protrusion 21 on the connector 2 can increase the creepage distance of the bulb holder structure to a certain extent. In order to improve the structural strength of the protrusion 21 and avoid damage caused by stress concentration, the protrusion 21 is a truncated cone-shaped structure which allows the stress applied on one side of the protrusion 21 to be released through the arc-shaped peripheral side structure.

In addition, in order to make the through hole 22 of the protrusion 21 more tightly fit with the conductive rivet of the bulb during assembling, in this embodiment, an end portion of the protrusion 21 away from the bulb cap 1 is further provided with a sunken portion 211 matched with the structure of the conductive element.

In order to further improve the creepage distance, in this embodiment, an end portion of the connector 2 close to the bulb cap 1 is provided with a threaded segment 23 matched with a structure of the end of the bulb cap 1. The threads on the threaded segment 23 suit the connection threads 11. Preferably, the threaded segment 23 of the connector 2 is 0.1-0.3 times the length of the bulb cap 1 in axial direction of the bulb cap 1.

With the above construction, when the bulb holder structure is screwed into the light socket, the threaded segment 23 on the connector 2 and the connection threads 11 on the bulb cap 1 are both threadedly connected with the light socket, so that the creepage distance of the bulb can be increased, while the relative position of the connector 2 and the bulb cap 1 can be further fixed to secure the joint.

In the configuration that the connector 2 is provided threaded segment 23, preferably, the connector 2 in this embodiment is a hollow shell structure, and an inner diameter of an end portion of the threaded segment 23 close to the bulb cap 1 is smaller than that of the bulb cap 1, so the end portion of the threaded segment 23 close to the bulb cap 1 is fitted with an inner peripheral side of the end of the bulb cap 1.

In terms of the specific implementation structure of the connection part 12, in this embodiment, more than one connection part 12 may be provided, and the connection parts 12 are spaced with intervals on a circumferential sidewall of the bulb cap 1 at the end close to the threaded segment 23. In this embodiment, there are four connection parts 12 as shown in the drawings. The four connection parts 12 are arranged in the form of a circular shape. The end portion of the threaded segment 23 close to the bulb cap 1 is provided with convex parts 231 extending outward, and the convex parts 231 are arranged in one-to-one correspondence with the connection parts 12 and are filled in the connection parts 12. In this embodiment, when the connection parts 12 are blind holes, the connection parts 12 are arranged on an inner circumferential side of the bulb cap 1; when the connection parts 12 are through holes, an outer contour of the convex parts 231 suits with an outer circumferential side of the bulb cap 1.

Embodiment 2

Figure 4:
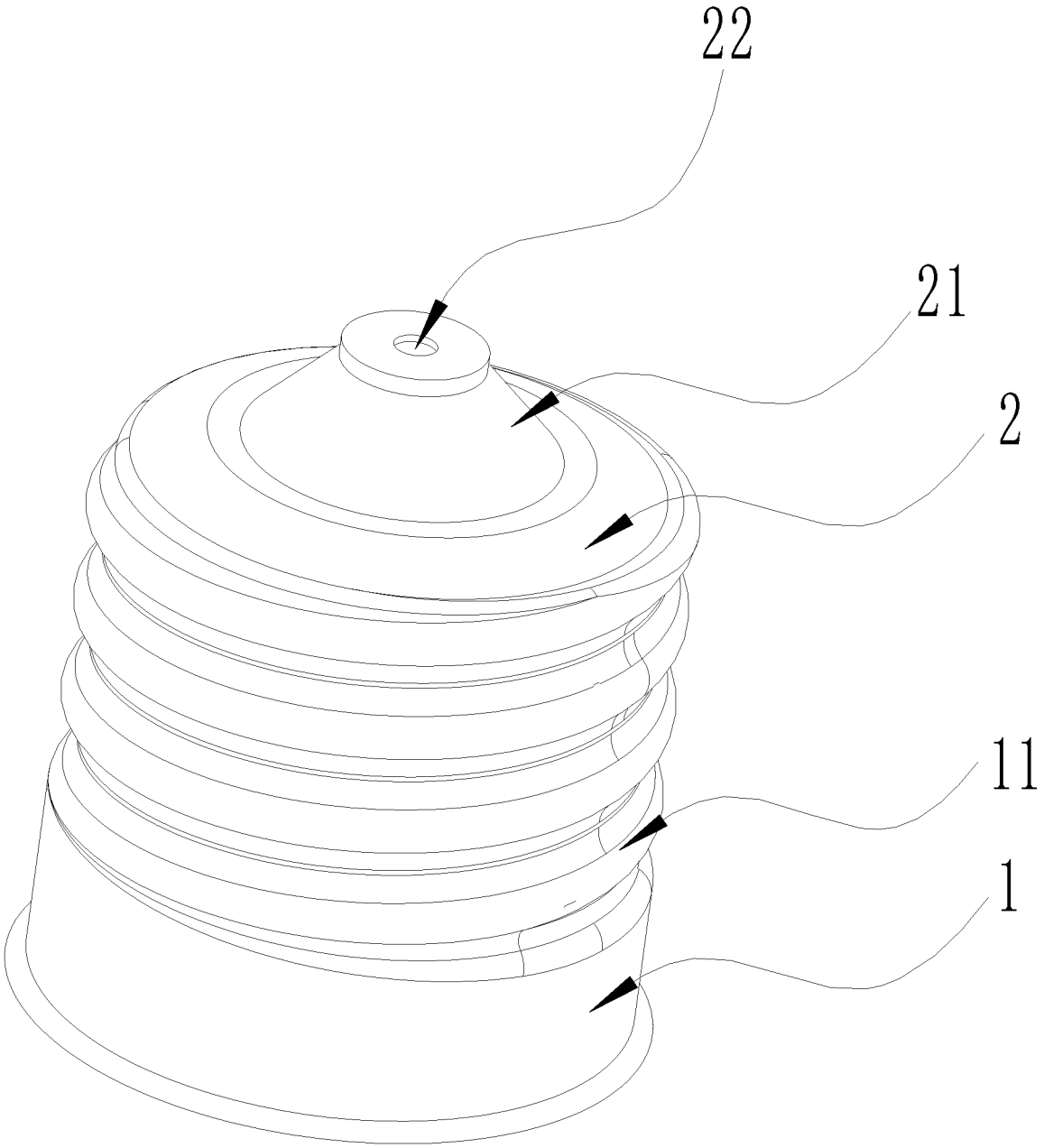
FIG. 4 is a schematic diagram showing one implementation structure of a bulb cap according to embodiment 2 of the present disclosure.
Figure 5:
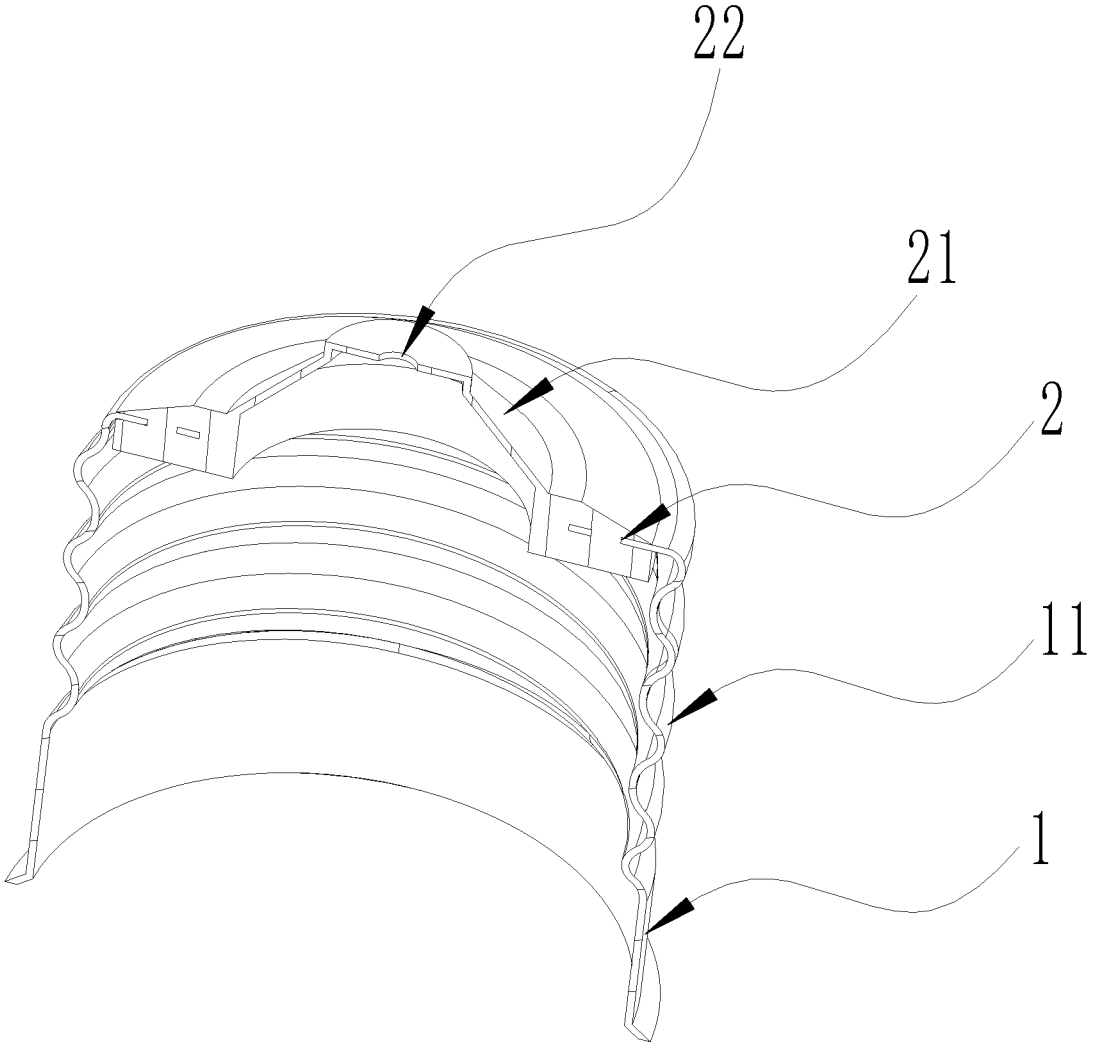
FIG. 5 is a cross-sectional diagram showing one implementation structure of a bulb cap according to embodiment 2 of the present disclosure.
Figure 6:
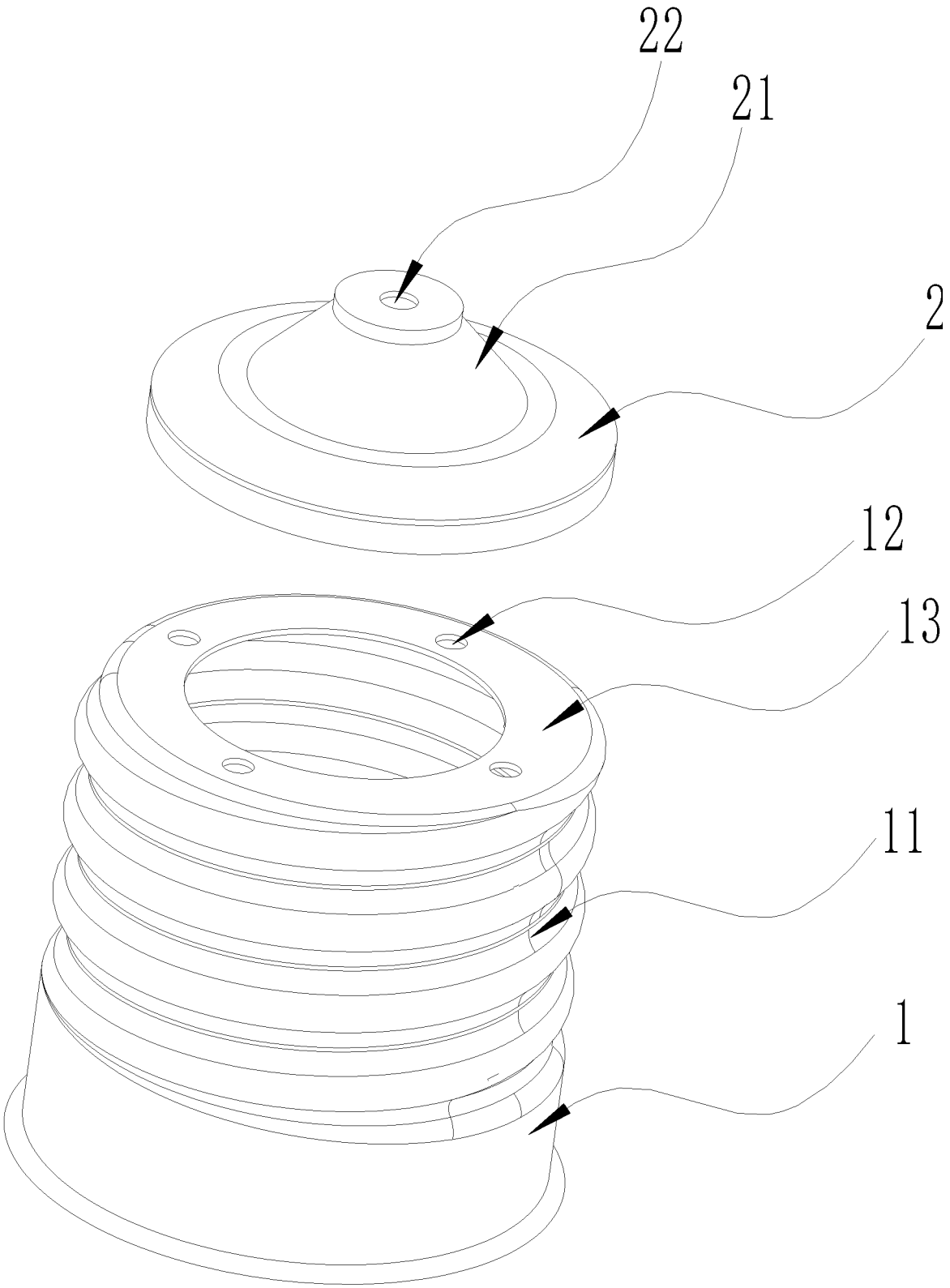
FIG. 6 is an exploded view showing one implementation structure of a bulb cap according to embodiment 2 of the present disclosure.

As shown in FIGS. 4-6, the present embodiment provides a light bulb holder structure which includes a bulb cap 1 and a connector 2. The bulb cap 1 has a cylindrical structure and is formed of a conductive material (for example, copper), and an end of the bulb cap 1 is connectable with a light socket. The connector 2 is made of insulating material (for example, plastics or silicone) and is integrally formed at the end of the bulb cap 1, a center of the connector 2 is provided with a protrusion 21 extending outward from the connector 2 in a direction away from the bulb cap 1, a center of the protrusion 21 is provided with a through hole 22, the through hole 22 is used for inserting a conductive element.

In order to facilitate the installation of the light bulb, in this embodiment, an outer circumferential side of the bulb cap 1 is provided with connection threads 11 matched with the light socket. In this embodiment, the protrusion 21 on the connector 2 can increase the creepage distance of the bulb holder structure to a certain extent. In order to improve the structural strength of the protrusion 21 and avoid damage caused by stress concentration, the protrusion 21 is a truncated cone-shaped structure which allows the stress applied on a side of the protrusion 21 to be released through the arc-shaped peripheral side structure.

In this embodiment, the end of the bulb cap 1 close to the connector 2 is provided with a contracted part 13, more than one connection part 12 is provided, and the connection parts 12 are arranged on the contracted part 13 at intervals. The connection parts 12 are through holes or blind holes. In this embodiment, four connection parts 12 are provided and the four connections parts are all through holes.

In addition, in this embodiment, the end portion of the connector 2 close to the bulb cap 1 penetrates into the contracted part 13 to partially encapsulate the contracted part 13 and completely encapsulate the connection parts 12. With this configuration, the tightness and strength of the connection between the connector 2 and the bulb cap 1 can be greatly improved.

The above descriptions merely involve part of the embodiments of the present disclosure, and are not intended to limit the scope of the present disclosure. Any equivalent device or equivalent process change made based on the contents of the description and drawings of the present disclosure, or same or similar structure directly or indirectly applied to other related technical fields should be considered as falling within the scope of protection of the present disclosure.

What is claimed is:

1. A light bulb holder structure, comprising:

a bulb cap, wherein the bulb cap has a cylindrical structure and is formed of a conductive material, and an end of the bulb cap is connectable with a light socket;

a connector, wherein the connector is made of insulating material and is molded at the end of the bulb cap to form an integration, a center of the connector is provided with a protrusion extending outward from the connector in a direction away from the bulb cap, a center of the protrusion is provided with a through hole, and the through hole is used for inserting a conductive element;

wherein, the end of the bulb cap is provided with a connection part fitted and connected with the connector, and the connection part is a through hole or a blind hole;

the end of the bulb cap close to the connector is provided with a contracted part, more than one connection part is provided, and the connection parts are arranged on the contracted part at intervals.

2. The light bulb holder structure according to claim 1, wherein an outer circumferential side of the bulb cap is provided with connection threads matched with the light socket, and the protrusion has a shape of circular truncated cone.

3. The light bulb holder structure according to claim 2, wherein a end portion of the protrusion away from the bulb cap is further provided with a sunken portion matched with a structure of the conductive element.

4. The light bulb holder structure according to claim 2, wherein an end portion of the connector close to the bulb cap is provided with a threaded segment matched with a structure of the end of the bulb cap, and threads on the threaded segment suit the connection threads.

5. The light bulb holder structure according to claim 4, wherein the threaded segment of the connector is 0.1-0.3 times the length of the bulb cap in axial direction of the bulb cap.

6. The light bulb holder structure according to claim 5, wherein the connector is a hollow shell structure, an inner diameter of an end portion of the threaded segment close to the bulb cap is smaller than that of the bulb cap, and the end portion of the threaded segment close to the bulb cap is fitted with an inner peripheral side of the end of the bulb cap.

7. The light bulb holder structure according to claim 6, wherein more than one connection part is provided and the connection parts are spaced with intervals on a circumferential sidewall of the bulb cap at the end close to the threaded segment, and the end portion of the threaded segment close to the bulb cap is provided with convex parts extending outward, and the convex parts are arranged in one-to-one correspondence with the connection parts and are filled in the connection parts; when the connection parts are blind holes, the connection parts are arranged on an inner circumferential side of the bulb cap; when the connection parts are through holes, an outer contour of the convex parts suits with an outer circumferential side of the bulb cap.

8. The light bulb holder structure according to claim 1, wherein the connection parts are through holes, and the end portion of the connector close to the bulb cap penetrates into the contracted part to partially encapsulate the contracted part and completely encapsulate the connection parts.

9. A light, comprising a light bulb holder structure, wherein the light bulb holder structure comprises:

a bulb cap, wherein the bulb cap has a cylindrical structure and is formed of a conductive material, and an end of the bulb cap is connectable with a light socket;

a connector, wherein the connector is made of insulating material and is molded at the end of the bulb cap to form an integration, a center of the connector is provided with a protrusion extending outward from the connector in a direction away from the bulb cap, a center of the protrusion is provided with a through hole, and the through hole is used for inserting a conductive element;

wherein, the end of the bulb cap is provided with a connection part fitted and connected with the connector, and the connection part is a through hole or a blind hole;

the end of the bulb cap close to the connector is provided with a contracted part, more than one connection part is provided, and the connection parts are arranged on the contracted part at intervals.

* * * * *